US010461413B2

(12) United States Patent
Eshaghi et al.

(10) Patent No.: US 10,461,413 B2
(45) Date of Patent: Oct. 29, 2019

(54) ENCLOSURE FOR MILLIMETER-WAVE ANTENNA SYSTEM

(71) Applicant: PERASO TECHNOLOGIES INC., Toronto (CA)

(72) Inventors: Armaghan Eshaghi, Newmarket (CA); Pradeep Persaud, Richmond Hill, NY (US)

(73) Assignee: PERASO TECHNOLOGIES INC., Toronto (CA)

( * ) Notice: Subject to any disclaimer, the term of this patent is extended or adjusted under 35 U.S.C. 154(b) by 24 days.

(21) Appl. No.: 15/708,208

(22) Filed: Sep. 19, 2017

(65) Prior Publication Data

US 2018/0083352 A1 Mar. 22, 2018

Related U.S. Application Data

(60) Provisional application No. 62/396,694, filed on Sep. 19, 2016.

(51) Int. Cl.

| | |
|---|---|
| ***H01Q 1/42*** | (2006.01) |
| ***H01Q 1/22*** | (2006.01) |
| ***H01Q 1/00*** | (2006.01) |
| ***H01Q 1/02*** | (2006.01) |
| ***H01Q 1/38*** | (2006.01) |
| ***H01Q 21/22*** | (2006.01) |

(52) U.S. Cl.

CPC ..... *H01Q 1/42* (2013.01); *H01Q 1/007* (2013.01); *H01Q 1/02* (2013.01); *H01Q 1/2275* (2013.01); *H01Q 1/2291* (2013.01); *H01Q 1/38* (2013.01); *H01Q 21/22* (2013.01)

(58) Field of Classification Search

CPC ..... H01Q 1/42; H01Q 1/007; H01Q 1/02; H01Q 1/38

See application file for complete search history.

(56) References Cited

U.S. PATENT DOCUMENTS

| | | | | |
|---|---|---|---|---|
| 2008/0191940 | A1* | 8/2008 | Haskell | H01P 5/222 342/373 |
| 2008/0316140 | A1* | 12/2008 | Wu | H01Q 1/425 343/872 |
| 2014/0327595 | A1* | 11/2014 | Van Oosterbosch | B29C 70/04 343/872 |
| 2015/0333392 | A1* | 11/2015 | Thiam | H01Q 9/0407 370/297 |
| 2016/0142124 | A1* | 5/2016 | O'Keeffe | H04B 17/0085 455/562.1 |
| 2017/0346177 | A1* | 11/2017 | Nagata | H01Q 1/42 |
| 2017/0373387 | A1* | 12/2017 | Ohlsson | H01Q 1/02 |

* cited by examiner

*Primary Examiner* — Peguy Jean Pierre

(74) *Attorney, Agent, or Firm* — Perry + Currier Inc.

(57) ABSTRACT

A phased array antenna system is provided, comprising a support member having a mounting surface; a plurality of electronic components supported on the mounting surface; an antenna supported on the support member adjacent to a perimeter of the mounting surface, for transmitting and receiving ultra-high frequency radio waves of wavelength λ; and an enclosure. The enclosure includes a top portion and a bottom portion for enclosing the support member and a radome for enclosing the antenna. The center of curvature of the radome is positioned less than 1λ from an end of the antenna. The thickness of the radome is approximately λ/5 and the radius of the radome is less than 1λ.

19 Claims, 3 Drawing Sheets

ENCLOSURE FOR MILLIMETER-WAVE ANTENNA SYSTEM

FIELD

This specification relates to wireless communications, and more particularly to a phased array antenna system and an enclosure with radome for a millimeter-wave antenna system.

BACKGROUND

The unlicensed millimeter-wave (MMW) band of 57 GHz to 66 GHz has been distinguished as a highly promising candidate for high-data-rate short-range wireless communication utilizing the Institute of Electrical and Electronics Engineers (IEEE) 802.11ad standard, also referred to as WiGig, which employs frequencies of about 57 GHz to about 66 GHz). For example, broadband phased array systems are known that utilize antenna-in-package (AiP) for integrating MMW phased array planar antennas and associated radio-frequency (RF) components, together with base-band circuitry, into a complete self-contained module (e.g. USB dongle).

The performance of such antenna systems is dependent on the design and geometry of the surrounding enclosure or casing shell, particularly the radome that protects the antenna array. Non-optimal prior art enclosure shapes and antenna-to-enclosure distances are known to result in mm-wave signal distortions. The antenna main lobe is attenuated because of the loss characteristics of the radome material. Moreover, secondary radiation sources are formed because radio waves reflect off and are diffracted by non-transmissive surfaces and discontinuities in the enclosure. Surface waves are also diffracted from edges, slots, and corners. The secondary radiation sources and diffracted fields can be in-phase or out-of-phase with the main beam, giving rise to ripples in the antenna radiation pattern and power losses up to 4 dBm at some angles. Also, if the antenna is placed too far from the end of the enclosure, the illuminated area of the antenna is large, causing secondary out-of-phase radiation sources.

From the foregoing, it will be appreciated that there is a need for optimally designed enclosures for antenna systems that minimize one or more prior art disadvantages such as reduced antenna coverage, gain and radiation pattern degradation, EIRP (Equivalent Isotropically Radiated Power) level decrease, undesired beam tilt and undesired ripples and nulls in the radiation pattern that are characteristic of prior art short range and indoor wireless WiGig antenna systems.

SUMMARY

In a general aspect, an antenna system is provided and an enclosure with a radome therefor, having a construction and geometry that minimizes ultra high frequency impairments while being of low cost and simple to manufacture.

Therefore, in accordance with one aspect, there is provided an antenna system, comprising: a support member having a mounting surface; a plurality of electronic components supported on the mounting surface; an antenna supported on the support member adjacent to a perimeter of the mounting surface, for transmitting and receiving ultra-high frequency radio waves of wavelength λ; and an enclosure having a top portion and a bottom portion for enclosing the support member and a radome for enclosing the antenna, wherein the center of curvature of the radome is positioned less than 1λ from an end of the antenna elements, the radome has a thickness of approximately λ/5 and the radome has a radius of less than 1λ.

In accordance with another aspect, there is provided an enclosure for an antenna system, said antenna system having an antenna supported at a perimeter of a support member mounting surface, for transmitting and receiving ultra-high frequency radio waves of wavelength λ, comprising: a top portion; a bottom portion; and a radome for enclosing the antenna, wherein the center of curvature of the radome is positioned less than 1λ from an end of the antenna elements, the thickness of the radome is approximately λ/5 and the radius of the radome is less than 1λ.

BRIEF DESCRIPTIONS OF THE DRAWINGS

Embodiments are described with reference to the following figures, in which.

DETAILED DESCRIPTION

Figure 1:
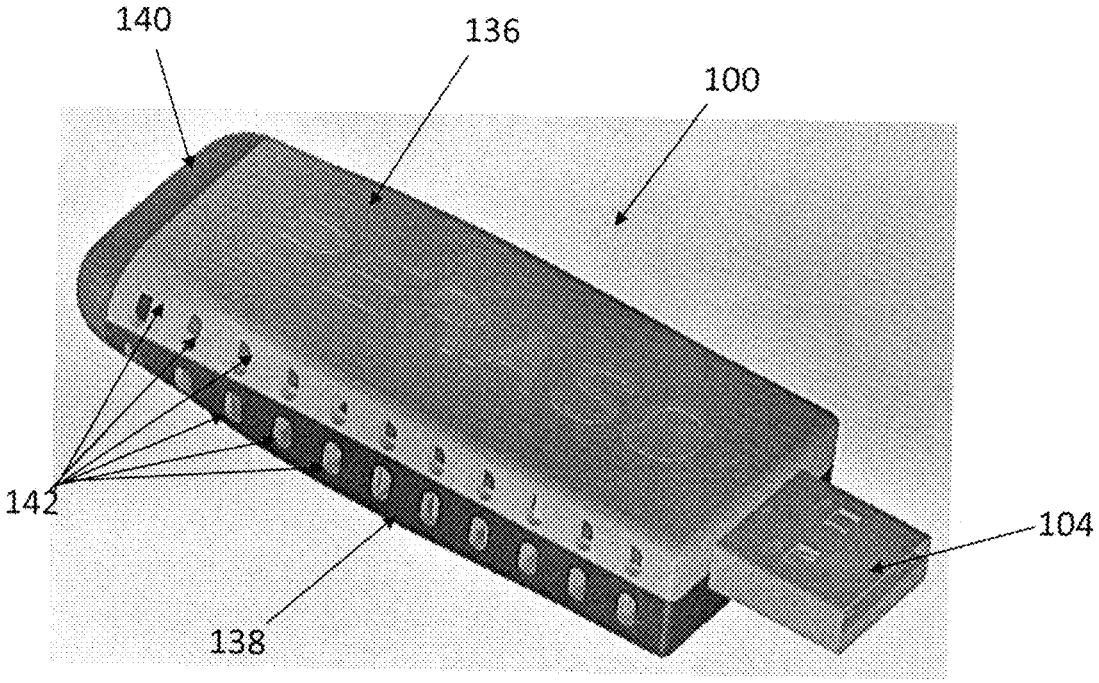
FIG. 1 is a perspective view a broadband antenna system, according to an embodiment.
Figure 2:
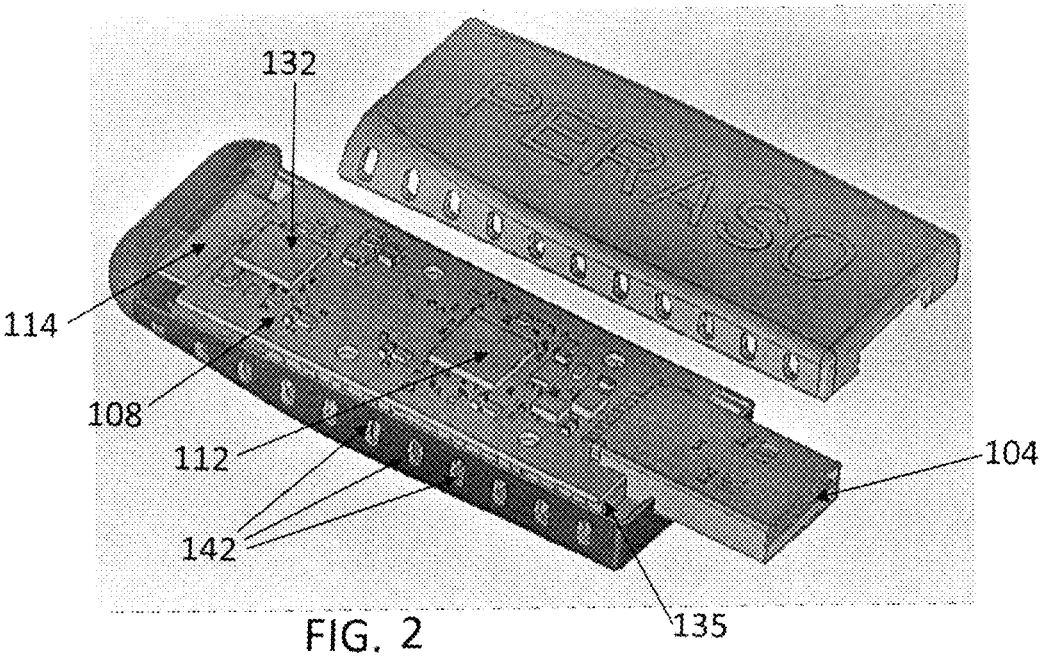
FIG. 2 is an exploded view of the broadband antenna system of FIG. 1 with a top portion of the enclosure removed.

FIGS. 1-2 depict an antenna system 100 (also referred to simply as the system 100 herein) configured to enable wireless data communications between computing devices (not shown), according to an aspect of the invention. In the present example, the wireless data communications enabled by the system 100 are conducted according to the Institute of Electrical and Electronics Engineers (IEEE) 802.11ad standard, also referred to as WiGig, which employs frequencies of about 57 GHz to about 66 GHz. As will be apparent, however, the system 100 may also enable wireless communications according to other suitable standards, employing other frequency bands. The system 100 can be integrated with a computing device, or, as shown in FIG. 1, can be a discrete device that is removably connected to a computing device. As a result, the system 100 includes a communications interface 104, such as a Universal Serial Bus (USB) port, configured to connect the remaining components of the system 100 to a host computing device (not shown).

The system 100 includes a support member 108 defining a mounting surface. In the present example, the support member 108 is a printed circuit board (PCB) with mounting surface for carrying the above-mentioned communications interface 104, antenna 114, and a plurality of electronic components including a baseband controller 112 and a radio controller 132.

The baseband controller 112 is implemented as a discrete integrated circuit (IC) in the present example, such as a field-programmable gate array (FPGA). In other examples, the baseband controller 112 may be implemented as two or more discrete components. In further examples, the baseband controller 112 is integrated within the support member 108.

In the present example, the baseband controller 112 is connected to the support member 108 via any suitable surface-mount package, such as a ball-grid array (BGA) or flip-chip package that electrically couples the baseband controller 112 to signal paths (also referred to as leads, traces and the like) formed within the support member 108 and connected to other components of the system 100. For example, the support member 108 defines signal paths (not shown) between the baseband controller 112 and the communications interface 104. Via such signal paths, the baseband controller 112 transmits data received at the system 100 to the communications interface for delivery to a host computing device, and receives data from the host computing device for wireless transmission by the system 100 to another computing device.

Similarly, the radio controller 132 is connected to the support member 108 via any suitable surface-mount package, such as a ball-grid array (BGA) or flip-chip package that electrically couples the radio controller 132 to signal paths formed within the support member 108 and connected to antenna 114 for transmitting radio signals received from the baseband controller 112 to the antenna 114 for wireless transmission and for transmitting radio signals received by the antenna 114 to the baseband controller 112 for demodulation and decoding by the phased array antenna system.

Alternatively, the support member 108, baseband controller 112 and radio controller 132 may be integrated as a part of the printed circuit board, and may therefore be fabricated by the same set of processes as the support member 108.

Antenna 114 is supported at an end of the support member 108 that is opposite the communications interface 104, and adjacent to a perimeter of the mounting surface. Although not illustrated, antenna 114 may include two antenna elements—one for receiving and one for transmitting radio signals, which can for example be printed circuit elements. Alternatively, antenna 114 may be replaced by a phased array of multiple antenna elements, such as double-sided dipole antenna elements, arranged on different sides, where each antenna array is steerable independently of the other antenna arrays.

The support member 108 is surrounded by a protective enclosure having a top portion 136 and a bottom portion 138 for enclosing the support member 108, and a radome 140 for enclosing the antenna 114. Top and bottom portions 136 and 138 can be fabricated from the same or a different material as radome 140, although the fabrication material of radome 140 should be chosen for its propagation characteristics. In one aspect, the material is a plastic, such as but not limited to polycarbonate and butadiene styrene. Top and bottom portions 136 and 138 are provided with openings or slots 142 to allow airflow for thermal cooling of the electrical components on support member 108 via heat exchange using a heat sink 135 (FIG. 2) mounted to a bottom surface of the support member 108. Alternatively, the heat sink can be mounted to a top surface of support member 108.

Figure 3:
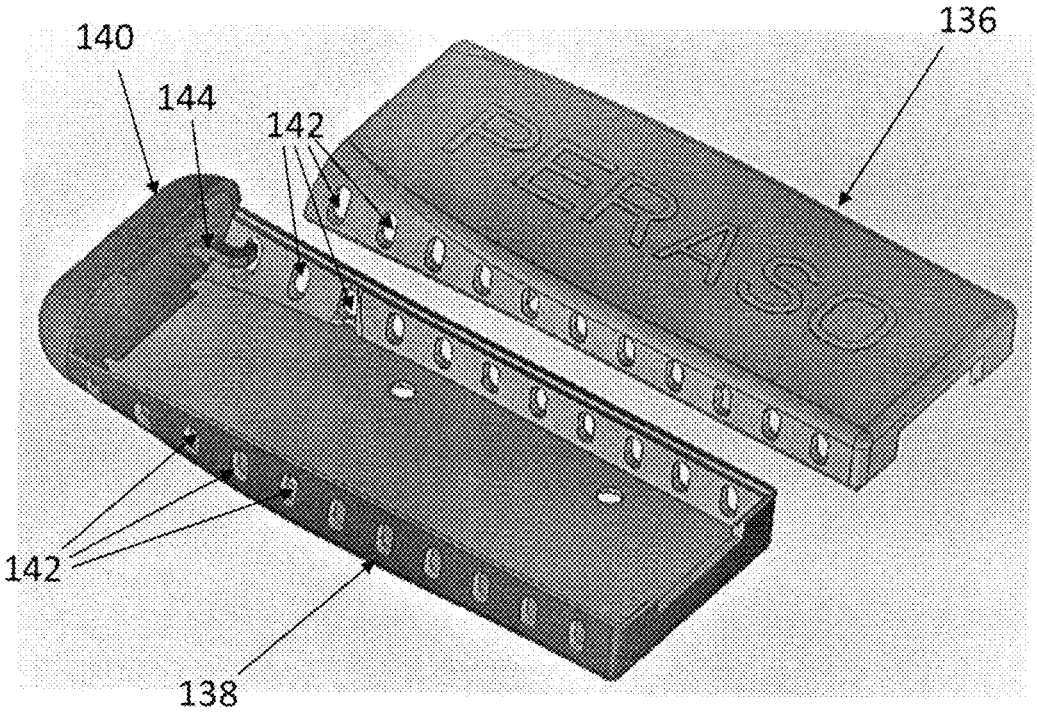
FIG. 3 is an exploded view of the enclosure for the antenna system of FIGS. 1 and 2 showing top and bottom portions thereof and a radome connected to the bottom portion.

As shown in FIG. 3, radome 140 is attached to lower portion 138 of the enclosure via a pair of clips 144 at opposite side edges of the radome 140 (see FIG. 4), which connect to a pair of the slots 142 nearest the antenna 114. A pair of upper and lower lips 146 extend from radome 140, as shown in FIGS. 3-6, which are adapted to fit into correspondingly sized indentations (not shown) in the upper and lower portions 136 and 138 of the enclosure, for additional structural rigidity. Location of the clips 144 at opposite ends of the radome 140 minimizes generation of out-of-phase surface waves.

The enclosure is preferably designed with even and smooth surfaces to avoid wavelength-size discontinuities in the direction of the main radio beam. Also, the enclosure and radome are preferably designed to meet mechanical constraints including the absence of screws or metal clips and construction of a mechanically stable radome that does not dimple or buckle under normal handling.

Figure 4:
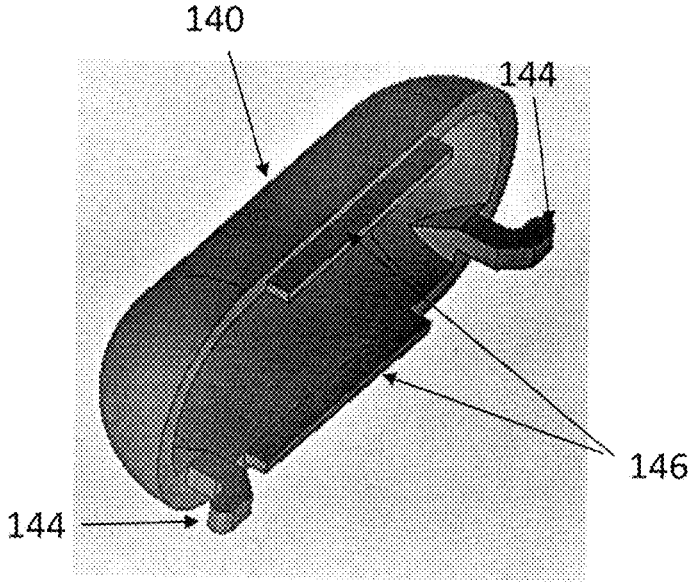
FIG. 4 is a perspective view of the radome of FIGS. 1-3, in isolation.
Figure 5:
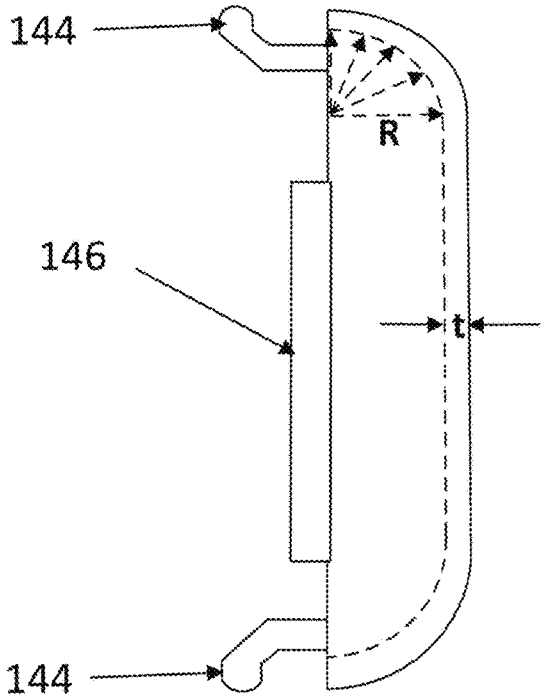
FIG. 5 is a top view of the radome of FIG. 4.
Figure 6:
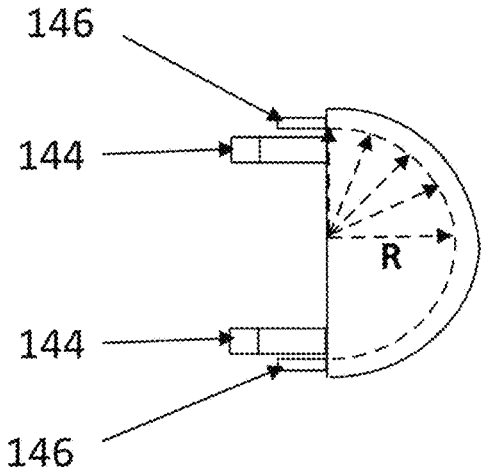
FIG. 6 is a side view of the radome of FIG. 4.

According to an aspect of the invention, the center of curvature of radome 140 is less than 1λ from antenna 114, where λ is the wavelength of the radio signal to be transmitted/received, in order to minimize the area illuminated by the antenna. Also, as shown in FIGS. 4-6, the thickness, t, of the radome is approximately λ/5 and the radius, R, of radome 140 is less than 1λ to further minimize generation of secondary sources. For operation at the 60 GHz WiGig frequency λ5=1 mm and 1λ=5 mm (i.e. the radius, R, of radome 140 must be less than 5 mm (e.g. 4 mm), as shown in FIGS. 5 and 6).

The scope of the claims should not be limited by the embodiments set forth in the above examples, but should be given the broadest interpretation consistent with the description as a whole.

The invention claimed is:

1. An antenna system, comprising:

a support member having a mounting surface;

a plurality of electronic components supported on the mounting surface;

an antenna supported on the support member adjacent to a perimeter of the mounting surface, for transmitting and receiving ultra-high frequency radio waves of wavelength λ; and an enclosure having a top portion and a bottom portion for enclosing the support member and a radome for enclosing the antenna, wherein a center of curvature of the radome is positioned less than 1λ, from an end of the antenna elements for minimizing the area illuminated by the antenna and minimizing secondary out-of-phase radiation sources, and wherein the radome has a thickness of approximately λ/5 and the radome has a radius of less than 1λ, for minimizing ripples in the antenna radiation pattern and power losses.

2. The antenna system of claim 1, further including includes a communications interface configured to externally connect the plurality of electronic components antenna system.

3. The antenna system of claim 2, wherein the communications interface is a Universal Serial Bus (USB) port.

4. The antenna system of claim 1, wherein the support member is a printed circuit board (PCB) with mounting surface for carrying said plurality of electronic components.

5. The antenna system of claim 2, wherein said plurality of electronic components includes a baseband controller for transmitting and receiving data via the communications interface.

6. The antenna system of claim 5, wherein said baseband controller is implemented as a discrete integrated circuit (IC).

7. The antenna system of claim 5, wherein said baseband controller is connected to the support member via a surface-mount package.

8. The antenna system of claim 7, wherein said plurality of electronic components includes a radio controller for transmitting radio signals received from the baseband controller to the antenna for wireless transmission and for transmitting radio signals received by the antenna to the baseband controller for demodulation and decoding by a phased array antenna system.

9. The antenna system of claim 8, wherein said radio controller is implemented as a discrete integrated circuit (IC).

10. The antenna system of claim 8, wherein said radio controller is connected to the support member via a surface-mount package.

11. The antenna system of claim 1, wherein said ultra-high frequency is 60 GHz, the thickness of the radome is approximately 1 mm, and the radius of the radome is less than 5 mm.

12. The antenna system of claim 1, wherein each of said top and bottom portions is provided with a plurality of slots to allow airflow for thermal cooling of said plurality of electronic components.

13. The antenna system of claim 12, further comprising a heat sink mounted to a bottom surface of the support member.

14. An enclosure for an antenna system, said antenna system having an antenna supported at a perimeter of a support member mounting surface, for transmitting and receiving ultra-high frequency radio waves of wavelength λ, comprising:

a top portion;

a bottom portion; and a radome for enclosing the antenna, wherein a center of curvature of the radome is positioned less than 1λ, from an end of the antenna elements for minimizing the area illuminated by the antenna and minimizing secondary out-of-phase radiation sources, and wherein the thickness of the radome is approximately λ/5 and the radius of the radome is less than 1λ, for minimizing ripples in the antenna radiation pattern and power losses.

15. The enclosure of claim 14, wherein said radome is attached to the bottom portion of the enclosure via a pair of clips at opposite side edges of the radome that connect to a pair of slots adjacent the antenna.

16. The enclosure of claim 14, wherein said radome further includes a pair of upper and lower lips that are adapted to fit into correspondingly sized indentations in the top and bottom portions of the enclosure.

17. The enclosure of claim 14, wherein said enclosure and radome are manufactured from a plastic material.

18. The enclosure of claim 14, wherein said ultra-high frequency is 60 GHz, the thickness of the radome is approximately 1 mm, and the radius of the radome is less than 5 mm at WiGig frequency band.

19. The enclosure of claim 14, wherein each of said top and bottom portions is provided with a plurality of slots to allow airflow for thermal cooling of said antenna system.

* * * * *